US006972109B1

(12) United States Patent
Spowart et al.

(10) Patent No.: US 6,972,109 B1
(45) Date of Patent: Dec. 6, 2005

(54) METHOD FOR IMPROVING TENSILE PROPERTIES OF ALSIC COMPOSITES

(75) Inventors: Jonathan E. Spowart, Dayton, OH (US); Benji Maruyama, Yellow Springs, OH (US); Daniel B. Miracle, Bellbrook, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 303 days.

(21) Appl. No.: 10/295,549

(22) Filed: Nov. 13, 2002

Related U.S. Application Data

(60) Provisional application No. 60/352,196, filed on Jan. 29, 2002.

(51) Int. Cl.[7] ..... B22F 3/12
(52) U.S. Cl. ..... 419/17
(58) Field of Search ..... 419/14, 17

(56) References Cited

U.S. PATENT DOCUMENTS 4,557,893 A * 12/1985 Jatkar et al. ..... 419/12
4,749,545 A * 6/1988 Begg et al. ..... 419/13
5,532,513 A 7/1996 Smith et al.
6,033,622 A 3/2000 Maruyama
6,162,497 A 12/2000 Beane et al.
6,228,140 B1 5/2001 Meeks et al.
6,280,496 B1 * 8/2001 Kawai et al. ..... 75/236
6,737,168 B1 * 5/2004 Yamagata et al. ..... 428/446

* cited by examiner

*Primary Examiner*—Daniel Jenkins
(74) *Attorney, Agent, or Firm*—AFMCLO/JAZ; Charles E. Bricker; Bart S. Hersko

(57) ABSTRACT

Metal-matrix composites with combinations of physical and mechanical properties desirable for specific applications can be obtained by varying and controlling selected parameters in the material formation processes, particularly by increasing the microstructural homogeneity of the composite, while maintaining a constant mixture ratio or volume fraction. In one embodiment of the invention, a CuSiC composite having increased thermal conductivity is obtained by closely controlling the size of the SiC particles. In another embodiment of the invention, AlSiC composites which exhibit increased ultimate tensile and yield strengths are made by closely controlling the size of SiC and Al particles.

4 Claims, 3 Drawing Sheets

METHOD FOR IMPROVING TENSILE PROPERTIES OF ALSIC COMPOSITES

This application claims benefit to provisional 60/352,196 filed Jan. 29, 2002.

RIGHTS OF THE GOVERNMENT

The invention described herein may be manufactured and used by or for the Government of the United States for all governmental purposes without the payment of any royalty.

BACKGROUND OF THE INVENTION

The present invention relates to metal matrix composites, particularly SiC-reinforced copper and aluminum.

The coefficient of thermal expansion (CTE) of a material is a factor representative of the degree to which a particular material expands (if a material has a positive CTE) or contracts (if a material has a negative CTE) as it is heated. Most materials have a positive CTE, and expand upon heating.

Materials having low or zero CTEs are useful as structural components in a variety of settings. For example, in fields such as high-power electronics, space optics, precision measurement devices, and the like, where precise measurements, tolerances, positions, and/or shapes of structural components is critical, the use of structural components having low or zero CTE is highly desirable, especially in situations in which the components are exposed to a variety of temperatures. In systems such as these, if structural components have higher CTEs, then as the temperature of the components varies, the components expand or contract, potentially disrupting measurements, settings, relationships between components, etc.

In many cases it is desirable that these components also be highly thermally conductive, such as in electronics thermal management, where high thermal conductivity and a low, tailorable coefficient of thermal expansion (CTE) are needed. For example, in the case of a substrate or a semiconductor chip used in relatively high-power electronics, the chip will generate significant heat and it is desirable that the substrate have high thermal conductivity to remove the heat from the chip.

Composites of metals and CTE-modifying additives find use in electronics thermal management applications. The metal component provides thermal and/or electrical conductivity, and the additive, which can be a ceramic with a CTE much lower than that of the metal, lowers the overall CTE of the composite. Because increasing the ceramic additive content generally decreases the thermal conductivity of the composite, it is desirable to use ceramic additives with CTEs as low as possible to minimize the required volume fraction of additive for a given composite, and thus maximize composite conductivity. Ceramics with negative CTEs thus are particularly attractive, and also provide the opportunity for thermally-conductive metal/ceramic composites with zero isotropic CTE (where the negative CTE of the ceramic offsets the positive CTE of the metal) for applications in precision optics and measurements.

Composites of the general type described above typically have been made by grinding components to fine powders, combining and mixing the powders, and applying pressure to the mixture, heating the mixture, or both. Most typically, a powder mixture is sintered or calcined at relatively high temperature, optionally with pressure, to form a composite.

Sintering of copper typically takes place above 800° C. Hot isostatic pressing of copper is normally carried out a temperatures above 600° C.

According to the Lacce "Rule of Mixtures," the intrinsic physical properties (e.g., thermal conductivity, coefficient of thermal expansion) of a heterogeneous article composed of at least two thoroughly mixed materials tend to vary approximately linearly with respect to the ratio of the volume of one of the materials to the volume of another of the materials. For example, a heterogeneous article composed of a 50—50 volumetric mixture of one material that has a low coefficient of thermal expansion and another material that has a high coefficient of thermal expansion can be expected to have a coefficient of thermal expansion that is the average of the coefficients of thermal expansion of the two materials.

Accordingly, it is an object of the present invention is to provide a method for the formation of metal-matrix composites with combinations of physical and mechanical properties desirable for specific applications.

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the present invention there are provided metal-matrix composites with combinations of physical and mechanical properties desirable for specific applications. Also provided are methods for forming these metal-matrix composites.

DETAILED DESCRIPTION OF THE INVENTION

Figure 1:
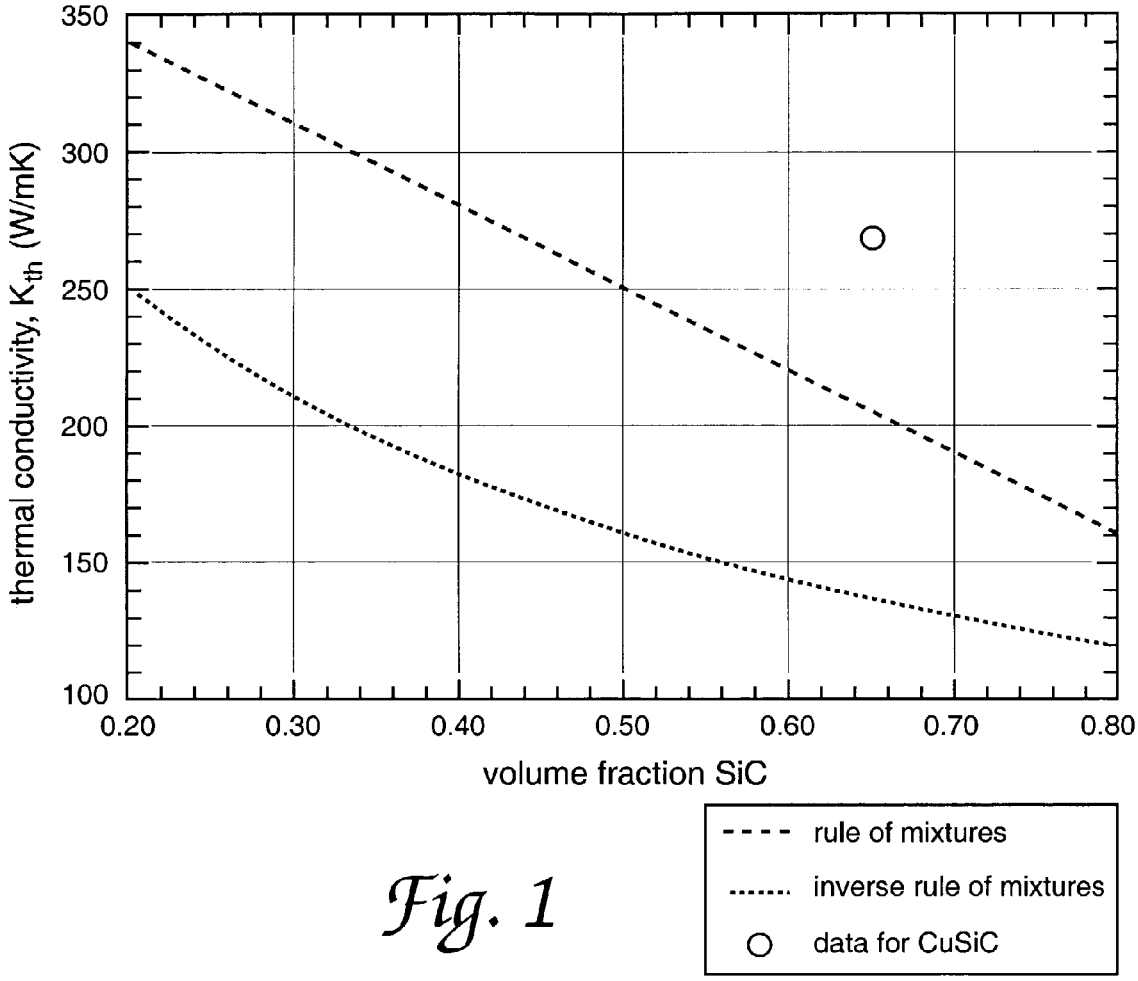
FIG. 1 graphically illustrates a CuSiC composite having increased thermal conductivity.

We have found that metal-matrix composites with combinations of physical and mechanical properties desirable for specific applications can be obtained by varying and controlling selected parameters in the material formation processes, particularly by increasing the microstructural homogeneity of the composite.

Useful metals for the composites of this invention are aluminum and copper and their alloys.

Useful ceramic materials for the composite include silicon carbide, silicon nitride, aluminum nitride, boron carbide, boron nitride, diamond and other thermally conductive ceramics, including glass ceramics. The preferred ceramic is silicon carbide because of its high thermal conductivity and its low coefficient of thermal expansion. The CTE of silicon carbide is lower than most ceramics and metals, therefore it is well suited for use in accordance with the invention.

Microstructural spatial homogeneity can be optimized by tightly controlling the size distribution of the powder particles to be blended together to form the composite material. This can be effected by screening, using sieves and/or filters, and/or by sedimentation (settling) techniques to precisely control the average size of each of the powders in the blend, and also to narrow the distribution of possible particle sizes in the starting powders. In general, powders that are closer in average size produce more spatially homogeneous composite materials when blended together, as the tendency for the smaller particles to arrange themselves in the interstices between the larger particles (thereby forming a more clustered microstructure) is thus avoided. The fabrication of a metal-matrix composite material with a more uniform distribution of phases by this technique leads to enhanced physical and/or mechanical properties over conventional metal-matrix composite materials.

Microstructural homogeneity can also be optimized by incorporating reinforcement particles that are more nearly round or ovoid, as compared to the as-received reinforcement, which is typically angular and of a higher aspect ratio. The rounded particles can be produced by milling or other high-energy grinding processes, either with or without process agents such as stearic acid or butanol. The more rounded reinforcement particles will be mechanically stronger and will have a reduced detrimental effect on the ductility and/or hot workability of the material than will the addition of conventional angular reinforcements. The resulting metal-matrix composite material will have enhanced tensile ductility and hot workability, as compared to a conventional metal-matrix composite with the same volume fraction of reinforcement, due to the absence of matrix stress concentrations associated with conventional, angular reinforcement particles. Enhancements in stiffness, yield strength and ultimate strength are largely unaffected by the rounded particle shape. An additional benefit of using more rounded reinforcement particles is in increased ease of mechanical mixing and/or blending, requiring shorter blending times and/or lower speeds to achieve the same uniformity of mixing.

Microstructural homogeneity can also be optimized by using a direct powder forging technique for fabricating the metal-matrix composite material, for example, the method disclosed in U.S. Pat. No. 6,355,209, issued Mar. 12, 2002, to Dilmore et al. This technique allows direct and rapid consolidation of matrix and reinforcement powders to form a fully-dense composite material. In a preferred embodiment, a matrix-coated particle precursor is used, whereby the reinforcement particles are continuously coated in the matrix material, at the required volume fraction. Particle coating can be accomplished by milling, plating, and the like. See, for example, U.S. Pat. No. 6,033,622, issued Mar. 7, 2000, to Maruyama, and U.S. Pat. No. 6,162,497, issued Dec. 19, 2000, to Beane et al. When non-coated reinforcement particles are used, it is preferred that the particle size ratio (PSR) of metal particles to reinforcement particles be less than 10, preferably less than 4.

In one embodiment of the invention, the ceramic material is silicon carbide with a uniform particle size of about 40–70 microns, the metal is copper, and the composite contains about 55–75 volume percent silicon carbide. In another embodiment of the invention, the ceramic material is silicon carbide, the metal is aluminum, and the composite contains about 20–30 volume percent silicon carbide. In this embodiment, aluminum powder is screened to obtain a uniform particle size of about 10 to 2 times the size of the silicon carbide particles and the composite contains about 20–30 volume percent silicon carbide.

The CuSiC composite of this invention is particularly useful as a substrate or package, and a heat sink for a semiconductor suitable for integrated circuits. The AlSiC composite of this invention is particularly useful as a structural material, where high stiffness, moderate strength and light weight are desirable, along with good wear-resistance.

The following examples illustrate the invention.

EXAMPLE 1

Crystolon-Green SiC F-320 was obtained from Saint-Gobain Ceramic Materials Inc, 1 New Bond Street, P.O. Box 15137, Worcester, Mass. 01615-0137. The SiC was screened to obtain a uniform particle size of 54 microns. The median sizes of the SiC particles before and after screening were measured using a photosedimentometer.

The sieved F-320 SiC was coated with copper, first electroless and then electro-chemically to obtain copper-coated SiC (CuSiC) with a uniform layer of approximately 6 microns of pure copper, to give an overall volume fraction of SiC of 65%.

The coated particles were cold isostatically pressed at 210 MPa at room temperature, inside an evacuated mild steel pouch in order to partially consolidate the particles into a forging pre-form. The pouch containing the powder was then placed inside a vacuum furnace at a temperature of 850° C. The pouch was transferred to a forging press, and isostatically forged for approximately 10 seconds at a pressure of 350 MPa, to form the finished articles. An acid etch was used to remove the mild steel pouch, and the specimens were cleaned using a grit-blasting unit.

Thermal conductivity in this material was measured at 268 W/mK, which is 135% of the value predicted using the rule-of-mixtures, due to enhanced levels of homogeneity in the microstructure. This value is shown graphically in FIG. 1, compared to the expected thermal conductivity of copper-silicon carbide composites based on the rule of mixtures.

EXAMPLE 2

F-600 grade SiC was screened to obtain particles of median diameter 13.4 microns. Aluminum alloy (6061-Al) matrix powders were screened to obtain particle sizes of 26.4, 42.0 and 108.6 microns.

Figure 2:
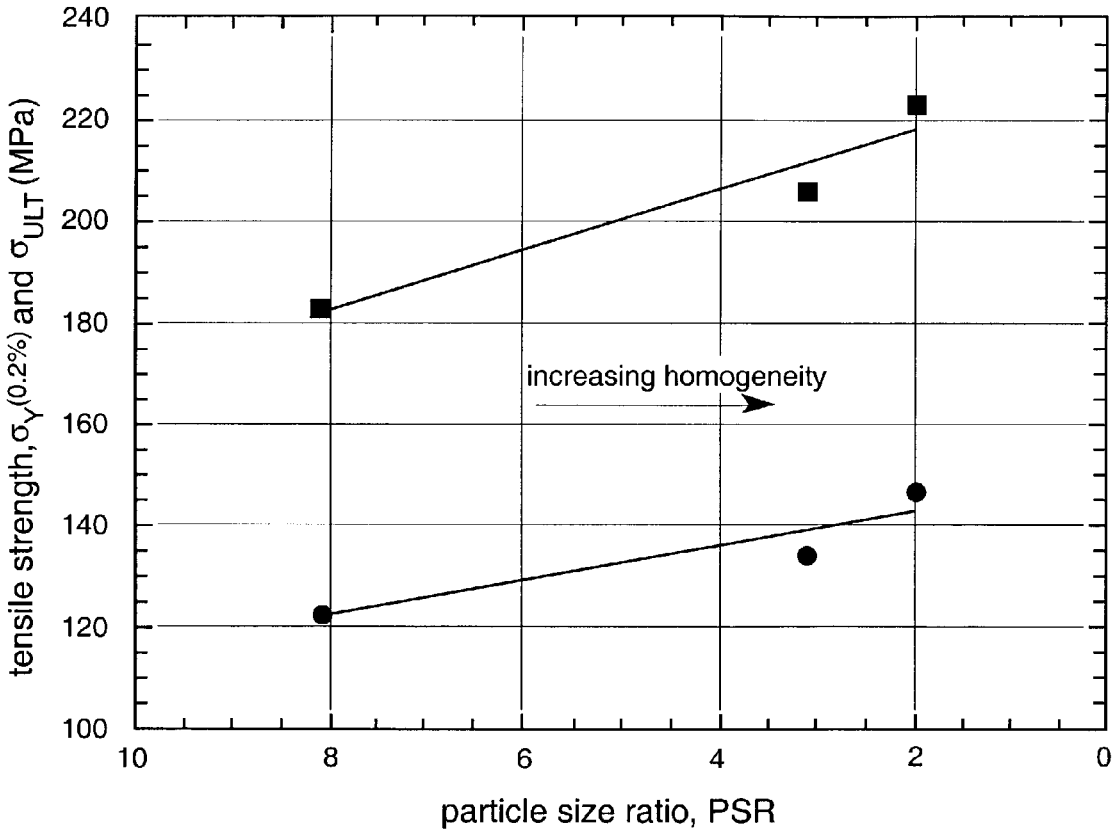
FIGS. 2 and 3 graphically illustrate the effects of spatial homogeneity for AlSiC composites.
Figure 2:
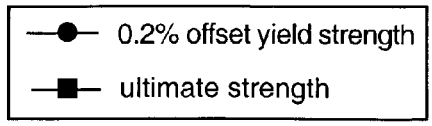
Figure 3:
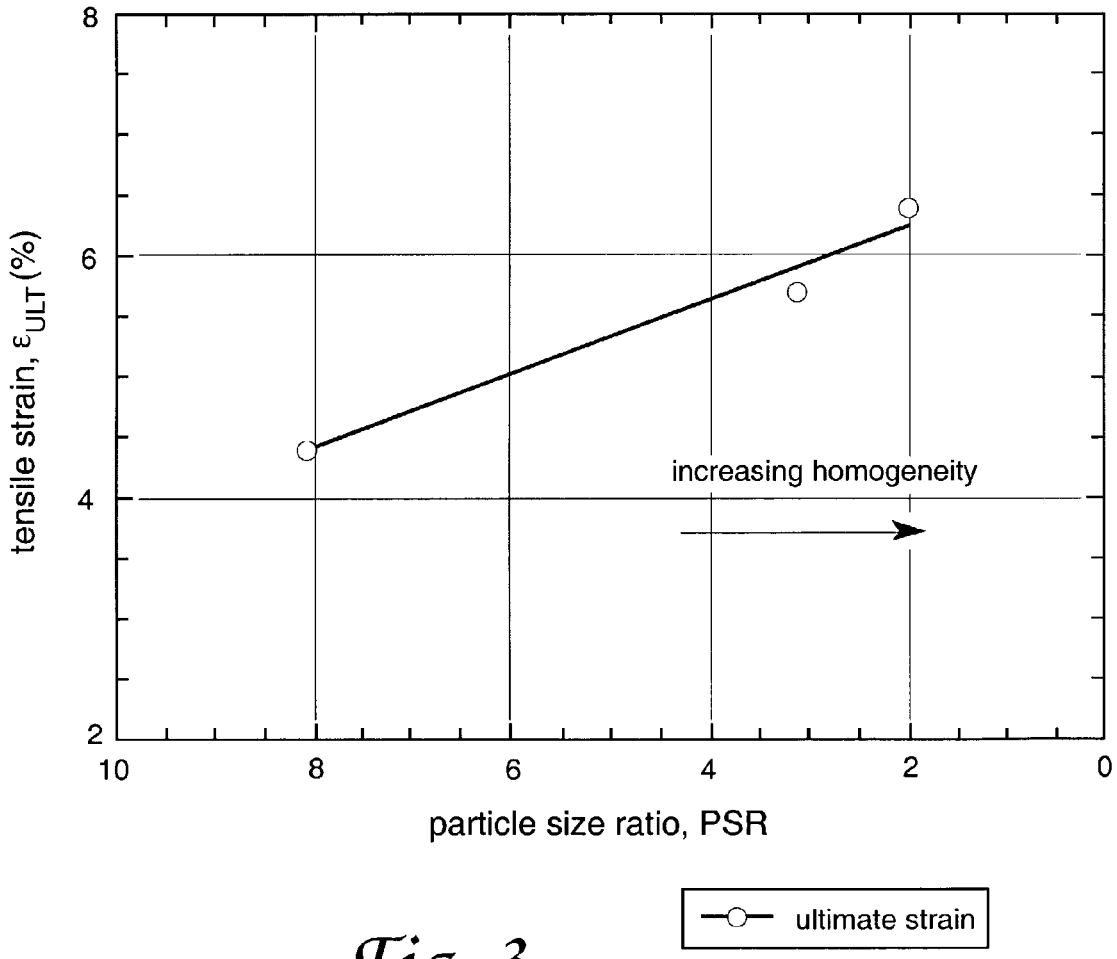

Each batch of aluminum powder was mechanically blended for 24 hours along with the SiC particles in a Turbula mixer-blender using butanol as a process agent, to prevent static electricity from building up on the particles and degrading the blending process. The butanol was removed by drying, and then a short (half-hour) dry blending was carried out to remove any agglomerates that might have formed during drying. The dry powder mixtures were put into aluminum cans. The cans were degassed at increasing temperatures up to 575° C., to drive off all the volatile species, then sealed under vacuum. The cans were then put into an extrusion press and compacted to approximately half their volume, using a blind die, at a temperature of 500° C. The compacted can was then extruded at 500° C. and a ram speed of 1 inch per minute to form an extruded rod of 0.5 inch nominal circular diameter (extrusion ratio 25:1), then left to cool to ambient temperature. The extruded rod was cut up to form tensile test coupons, and these were tested as per normal lab procedures. Tensile tests showed that there was an decrease in tensile ductility on going from the smaller to the larger matrix particles. FIG. 2 shows increasing ultimate tensile and yield strengths with increasing levels of spatial homogeneity. FIG. 3 shows increasing ultimate tensile strains with increasing levels of spatial homogeneity. These mechanical properties are not predicted by the rule-of-mixtures, which predicts similar properties in each case due to the same volume loading of reinforcement being used throughout. Notice also that changing the level of spatial homogeneity results in the highest ultimate tensile strains being recorded for those materials with the highest ultimate tensile strengths.

Having thus described exemplary embodiments of the present invention, it should be noted by those skilled in the art that the disclosures herein are exemplary only and that alternatives, adaptations and modifications may be made within the scope of the present invention.

We claim:

1. A method for producing an AlSiC composite having increased tensile yield strength, ultimate strength and ultimate strain, which consists essentially of the steps of (a) screening SiC particles to obtain a uniform particle size, (b) screening Al powder to obtain a uniform particle size of about 10 to 2 times the size of said SiC particles, (c) mixing said SiC particles with sufficient said Al powder to provide about 20 to 30 vol % SiC, and (d) consolidating said SiC particles and said Al powder to produce said AlSiC composite.

2. The method of claim 1 wherein said SiC particles have a particle size of about 13.4 microns and said Al powder has a particle size of about 26 to 109 microns.

3. The method of claim 1 wherein said mixture of SiC particles and Al powder is consolidated using a direct powder forging technique.

4. The method of claim 1 wherein said SiC particles are nearly round or ovoid in shape.

* * * * *